US005195736A

United States Patent [19]

Ishidate

[11] Patent Number: 5,195,736

[45] Date of Patent: Mar. 23, 1993

[54] METHOD AND APPARATUS FOR FEEDING SHEETS

[75] Inventor: Takeo Ishidate, Tokyo, Japan

[73] Assignee: Oki Electric Industry Co., Ltd., Tokyo, Japan

[21] Appl. No.: 761,009

[22] Filed: Sep. 17, 1991

[30] Foreign Application Priority Data

| | | | |
|---|---|---|---|
| Sep. 19, 1990 | [JP] | Japan | 2-249785 |
| Sep. 19, 1990 | [JP] | Japan | 2-249786 |
| Mar. 14, 1991 | [JP] | Japan | 3-022194 |
| Jun. 24, 1991 | [JP] | Japan | 3-177762 |

[51] Int. Cl.[5] ..... B65H 3/06; B65H 7/06; B65H 7/08

[52] U.S. Cl. ..... 271/22; 271/110; 271/122; 271/228

[58] Field of Search ..... 271/10, 16, 19, 21, 271/22, 42, 110, 117, 121, 122, 147, 227, 228

[56] References Cited

U.S. PATENT DOCUMENTS

| | | | |
|---|---|---|---|
| 4,463,943 | 8/1984 | Deconinck | 271/22 |
| 4,565,361 | 1/1986 | Tanaka et al. | 271/110 |
| 4,674,734 | 6/1987 | Ibuchi | 271/122 |
| 4,893,804 | 1/1990 | Sasage et al. | 271/122 |
| 4,928,951 | 5/1990 | Fukui | 271/122 |
| 5,052,673 | 10/1991 | Tokuda et al. | 271/22 |
| 5,072,924 | 12/1991 | Sugiyama | 271/110 |

FOREIGN PATENT DOCUMENTS

| | | | |
|---|---|---|---|
| 83025 | 7/1983 | European Pat. Off. | 271/22 |
| 1046359 | 12/1958 | Fed. Rep. of Germany | 271/22 |
| 23915 | 3/1965 | Japan | 271/21 |
| 28139 | 3/1981 | Japan | 271/16 |
| 104856 | 6/1983 | Japan | 271/110 |
| 208446 | 8/1988 | Japan | 271/110 |
| 68335 | 5/1989 | Japan . | |

*Primary Examiner*—Robert P. Olszewski
*Assistant Examiner*—Steven M. Reiss
*Attorney, Agent, or Firm*—Spencer, Frank & Schneider

[57] ABSTRACT

An apparatus for sequentially feeding an accumulation of sheets stored in a storing section thereof one by one to a predetermined transport path. A pressing member presses the accumulation of sheets to one side in a direction in which the sheets are accumulated. A pair of pick-up rollers abut against the surface of the accumulation of sheets at the above-mentioned one side. A pair of feed rollers are located at a predetermined feed position in parallel with the pair of pick-up rollers. Actuators cause the pick-up roller pair and the feed roller pair to move toward and away from each other in a reciprocating motion. A pair of reverse rollers are located to face the pair of feed rollers and rotatable in a counter-feed direction opposite to a predetermined feed direction. The pick-up rollers and feed rollers moving toward and away from each other pay out a sheet from one side of the accumulation. The reverse rollers are rotated in the counter-feed direction to separate a sheet being entrained by the sheet being paid out in close contact with it and return said the entrained sheet to the storing section. Opposite side edges of the sheet being paid out by the pick-up rollers and feed rollers are continuously sensed over a predetermined range to see if the sheet is entraining another sheet, is delayed, or is paid out askew. The amplitudes of movement of the individual rollers are controlled in a particular manner mathcing the condition wherein the sheet is paid out.

17 Claims, 12 Drawing Sheets

METHOD AND APPARATUS FOR FEEDING SHEETS

BACKGROUND OF THE INVENTION

1. Field of the Invention

The present invention relates to a sheet feeding apparatus incorporated in a cash dispenser, optical reader or similar equipment and, more particularly, to a method and an apparatus for sequentially feeding sheets such as bills, original documents or paper sheets one by one.

2. Description of the Prior Art

A sheet feeding apparatus for the above application usually has a storing section which stores a great number of bills, paper sheets or similar sheets therein, and a stage movable up and down in the storing section, as taught in, for example, Japanese Utility Model Laid-Open Publication No. 68335/1989. When the stage loaded with a stack of sheets is elevated to a predetermined feed position, the apparatus is ready to feed the sheets from the storing section, uppermost one being first. A pair of pick-up rollers are positioned at spaced locations along the length of the stack of sheets and rotated to pay out the uppermost sheet from the feed position. A pair of feed rollers are located in close proximity to the front end of the storing section with respect to the intended direction of sheet feed and in parallel with the pick-up rollers. The sheet paid out by the pick-up rollers is further driven by the feed rollers in the feed direction to a transport path which is contiguous with the storing section. It is a common practice to operatively connect the feed rollers and pick-up rollers by belts and pulleys and drive them by a single motor at the same speed in the feed direction. Such a configuration, however, needs a great number of parts including the belts and pulleys for interconnecting the feed rollers and pick-up rollers and the motor for driving the rollers, increasing the overall size of the apparatus. Moreover, pulleys and belts complicate the structure of the apparatus.

It often occurs that two or more of the sheets stacked on the stage adhere to one another due to static electricity or a similar cause and are fed out together unseparated. To eliminate such an occurrence, a reverse roller is associated with each of the feed rollers in such a manner as to contact the sheet underlying and paid out together with the uppermost sheet. The reverse rollers are rotated in the same direction as the feed rollers, i.e., in a counter-feed direction opposite to the feed direction. As a result, the sheet contacting the reverse rollers is urged backward, i.e., toward the storing section and thereby separated from the overlying or uppermost sheet. The degree of separation of the sheet depends on the gap between the feed rollers and the associated reverse rollers. An adjusting screw is affixed to the shaft of each feed roller in order to adjust the position of the feed roller. Specifically, should the gap between the feed rollers and the reverse rollers be greater than a predetermined one, the reverse rollers would fail to separate the underlying sheet from the overlying sheet and would cause the latter to entrain the former out of the storing section. Conversely, should the gap be smaller than the predetermined one, an excessive pressure applied on the sheets should act to delay the feed of the sheet of interest. Moreover, since one of the feed rollers and one of the reverse rollers are provided in a pair and locate at one of opposite sides of the stage in the left-and-right direction, any difference in gap between the right and left pairs would cause the sheet to skew with respect to the feed direction. The adjusting screws each being associated with respective one of the feed rollers have to be adjusted to eliminate the above occurrences. However, this adjustment is a measure to be taken after an error has occurred in the feed of sheets and, therefore, lacks in immediate adaptability. Feed errors cannot be fully eliminated by the conventional apparatus since the nip of the rollers tends to change due to the friction between the rollers and the friction between the rollers and the sheets. Even an implementation for automatically adjusting the gap between the feed rollers and the reverse rollers would fail to achieve a satisfactory result since the adjustment of the gap is delicate, minute and difficult.

When all the sheets intervening between the pick-up rollers and the stage have been fed out by the pick-up rollers, the pick-up rollers contact and rub against the stage to produce noise. Moreover, both the pick-up rollers and the stage wear in contact with each other, adversely effecting the feed of sheets.

SUMMARY OF THE INVENTION

It is therefore an object of the present invention to provide a method and an apparatus for feeding sheets which implement a miniature and simple construction.

It is another object of the present invention to provide a method and an apparatus for feeding sheets which, on the occurrence of a feed error, corrects the error by real-time and simple control.

It is another object of the present invention to provide a method and an apparatus for feeding sheets which reduce noise and the wear of a stage ascribable to the contact of pick-up rollers in rotation with the stage as far as possible.

In accordance with the present invention, an apparatus for sequentially feeding sheets one by one has a storing section for storing the sheets. Pay-out members pay out one of the sheets in a predetermined feed direction while causing part of the sheet to bend.

Also, in accordance with the present invention, an apparatus for sequentially feeding an accumulation of sheets stored in a storing section one by one in a predetermined feed direction which is substantially perpendicular to the direction of the accumulation, one of the sheets positioned at one side of the accumulation being first, has a pressing member for pressing the accumulation of sheets to one side in the direction of accumulation within the storing section. First pay-out members abut against the surface of the accumulation of sheets located at the above-mentioned one side and are repetitively movable along the surface in the feed direction to pull out the sheet from the accumulation. Second pay-out members are located downstream of the first pay-out members with respect to the feed direction for abutting against the sheet having been paid out by the first pay-out members and are movable in the feed direction in response to the movement of the first pay-out members to pay out the sheet further to a predetermined transport path. Separating members are located to face the second pay-out members for abutting against another sheet being entrained by the sheet having been paid out while adhering to the rear of the sheet and are movable in a counter-feed direction opposite to the feed direction to separate the another sheet from the sheet having been paid out.

Further, in accordance with the present invention, a method is provided for controlling an apparatus for sequentially feeding an accumulation of sheets stored in a storing section one one by comprising a pressing member for pressing the accumulation of sheets to one side in the direction of accumulation, a pair of pick-up rollers abutting against the surface of the accumulation of sheets at the above-mentioned one side, a pair of feed rollers located at a predetermined feed position in parallel with the pick-up rollers, roller moving members for causing the pick-up rollers and feed rollers to repetitively move toward and away from each other, and a pair of reverse rollers located to face the feed rollers and rotatable in a counter-feed direction opposite to a predetermined feed direction. The pick-up rollers and feed rollers repetitively move toward and away from each other to pay out the sheet positioned at one side of the accumulation. The reverse rollers are rotated in the counter-feed direction to separate another sheet being entrained by the sheet being paid out in close contact with the latter and return the entrained sheet to the storing section. The method senses opposite side edges of the sheet being paid out by the pick-up rollers and feed rollers continuously over a predetermined range and determines whether or not it is entraining another sheet, is delayed, or is paid out askew. If the sheet of interest is entraining another sheet, the amplitude of movement of the rollers caused by the roller moving members is reduced or the movement is once stopped. If the sheet is delayed, the amplitude of movement is increased. Further, if the sheet is paid out askew, the roller moving members are caused to increase or decrease the amplitude of movement if either one of each of the pairs of rollers.

BRIEF DESCRIPTION OF THE DRAWINGS

The above and other features of the present invention will become more apparent from the consideration of the following detailed description taken in conjunction with the accompanying drawings in which.

DESCRIPTION OF THE PREFERRED EMBODIMENTS

Figure 1:
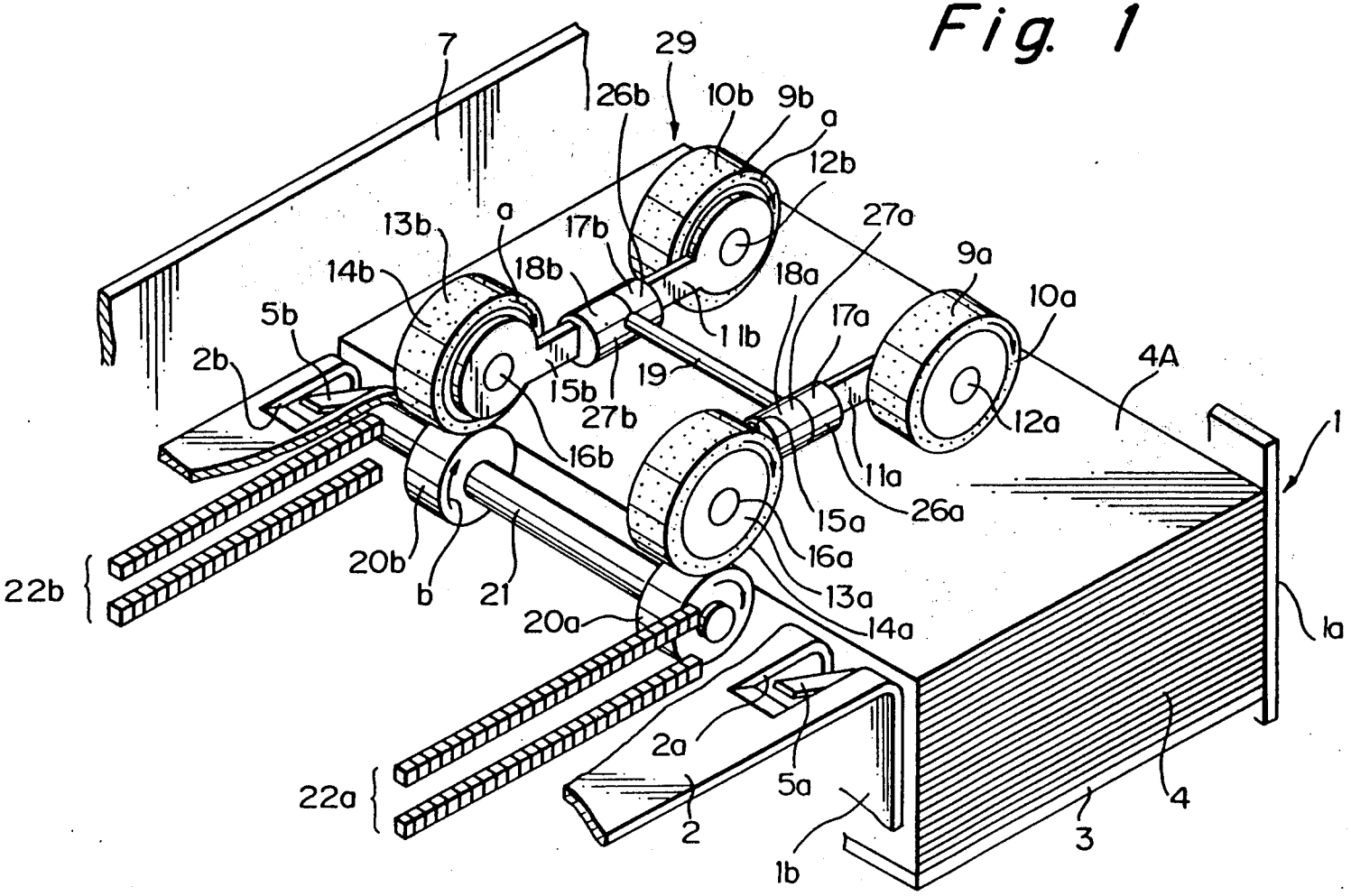
FIG. 1 is a perspective view showing a preferred embodiment of the sheet feeding apparatus in accordance with the present invention.
Figure 2:
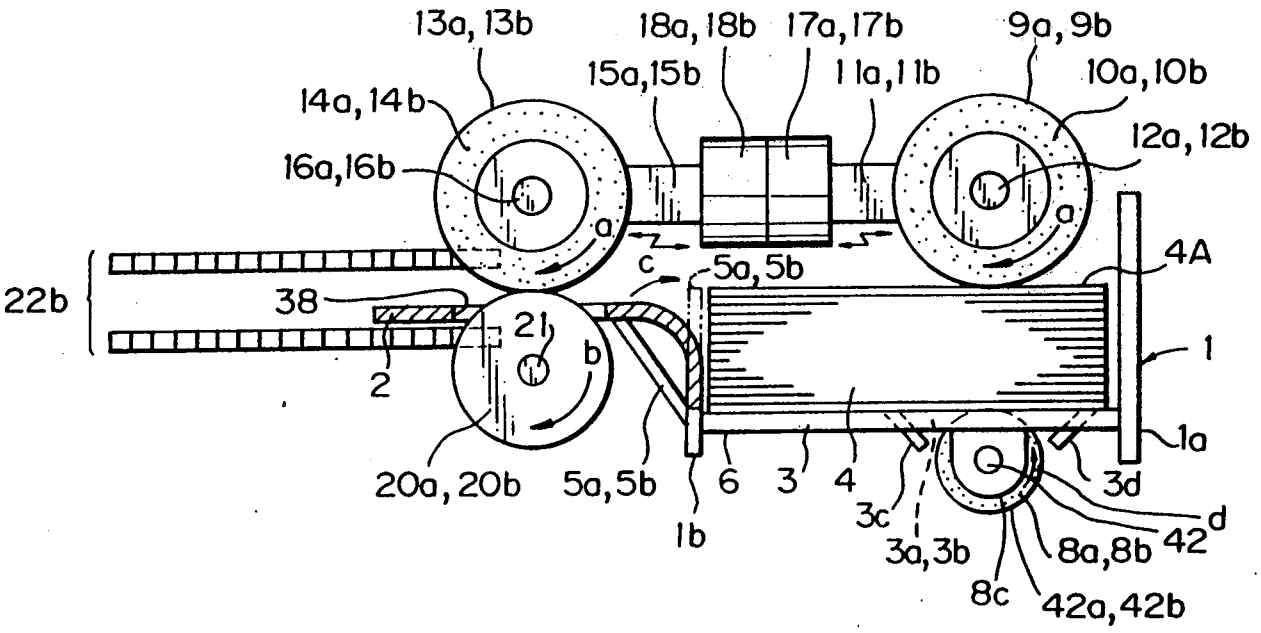
FIG. 2 is a fragmentary side elevation of the embodiment of FIG. 1.
Figure 3:
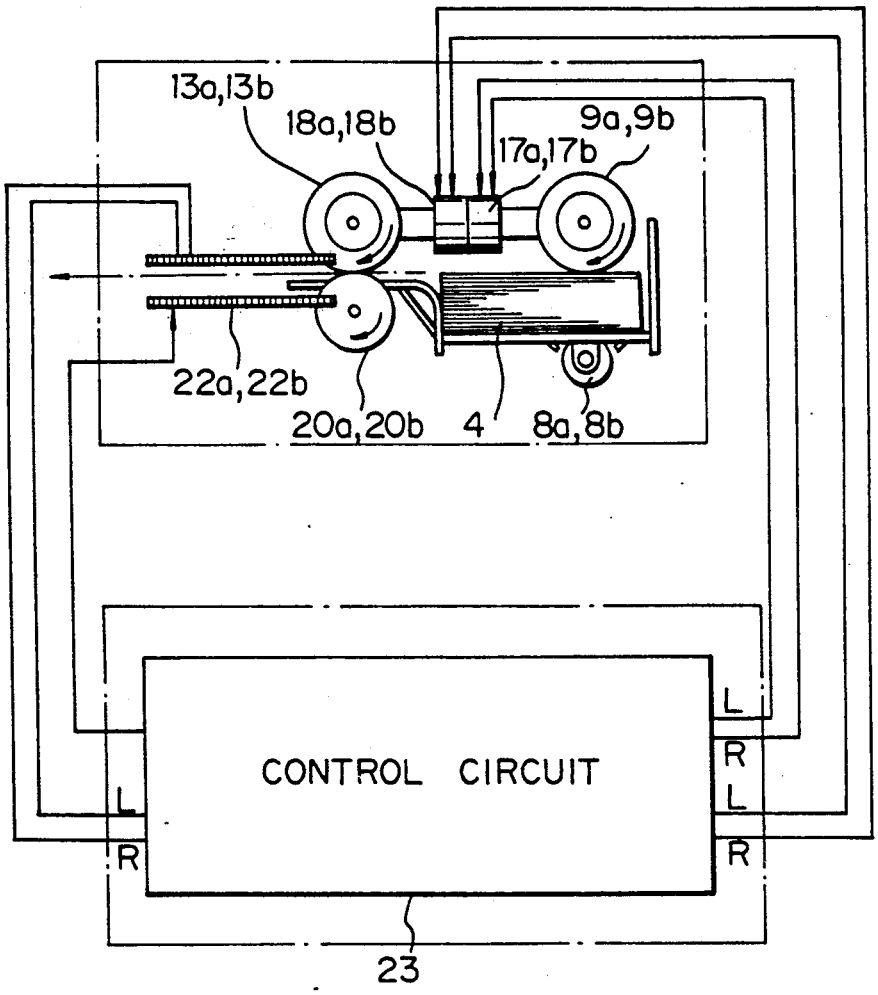
FIG. 3 is a block diagram schematically showing an electrical arrangement incorporated in the embodiment of FIG. 1 and including a control system.

Referring to FIGS. 1 through 3, a sheet feeding apparatus embodying the present invention is shown and includes a storing section 1 which stores a stack of sheets 4 therein. The storing section 1 is delimited by a rear frame member 1*a*, a front frame member 1*b*, and opposite side frame members 7 (only one is shown). The words "front", "rear", "upper" and "lower" which will repetitively appear hereinafter should be understood to refer respectively to the left, right, upper and lower sides as viewed in the figures. An elevatable stage or tray 3 is accommodated in the space defined by the frame members 1*a*, 1*b* and 7 and loaded with the sheets 4.

At a position for feeding the sheets 4, i.e., a feed position, the front frame member 1*b* is bent to form a forward extension which plays the role of a guide plate 2. The guide plate 2 extends substantially horizontally in an intended direction of sheet feed, or feed direction, to define a feed path. Elongate slots 2*a* and 2*b* are formed through opposite sides of the bend where the front frame 1*b* and guide plate 2 merge into each other. Reverse levers 5*a* and 5*b* are respectively received in the slots 2*a* and 2*b*, and each is rotated by a gear or a spring, not shown, in interlocked relation to the upward and downward movement of the stage 3. After a desired number of sheets 4 have been fed out from the stage 3, the reverse levers 5*a* and 5*b* return the sheets 4 having been entrained by those desired sheets 4 to the storing section 1. Specifically, as shown in FIG. 2, the reverse levers 5*a* and 5*b* each is rotatable about a fulcrum 6 to an upright position in a direction indicated by an arrow c, thereby forcing the sheets 4 into the storing section 1. It is to be noted that the reverse levers 5*a* and 5*b* each is so dimensioned as to prevent the sheets 4 once forced into the storing section 1 from protruding thereoutof due to vibration or similar cause. In the event of sheet feed, the reverse levers 5*a* and 5*b* are rotated in the opposite direction to the direction c to below the guide plate 2 so as not to interfere with the sheet 4.

The stage 3 serves as means for raising the stack of sheets 4 until the uppermost sheet 4 reaches a predetermined feed position. As shown in FIG. 2, parallel slots or openings 3*a* and 3*b* are formed through the stage 3 at spaced locations in the right-and-left direction and slightly rearwardly of the center of the stage 3. The slots 3*a* and 3*b* are respectively positioned beneath pick-up rollers 9*a* and 9*b* which will be described. Absorb rollers or tires rollers 8*a* and 8*b* are received in the slots 3*a* and 3*b*, respectively. The absorb rollers 8*a* and 8*b* each is rotatably mounted on a support plate or bracket 8*c* by a shaft 42. When most of the sheets 4 have been fed out of the storing section 1, the absorb rollers 8*a* and 8*b* cooperate with the pick-up rollers 9*a* and 9*b* to drive the small amount of remaining sheets out of the storing section 1. High friction members 42*a* and 42*b* are provided on the entire peripheries of the absorb rollers 8*a* and 8*b*, respectively. The absorb rollers 8*a* and 8*b* are respectively positioned in the slots 3*a* and 3*b* in such a manner as not to protrude from the upper surface of the stage 3. Rotation limiting means in the form of a one-way clutch, not shown, is built in each of the absorb rollers 8*a* and 8*b* to allow the latter to move only in a direction indicated by an arrow d. The diameter of the absorb rollers 8*a* and 8*b* is selected such that the pick-up rollers 9*a* and 9*b* are movable substantially horizontally without jumping up when moved by an actuator which will be described. The stage 3 is cut and bent downwardly at the front and rear of the absorb rollers 8a and 8b to form bent portions 3c and 3d, so that the slots 3a and 3b may not catch the sheets 4.

The pick-up rollers 9a and 9b are provided in a pair in an upper portion of the storing section 1 to face respectively the absorb rollers 8a and 8b with the intermediary of the stack of sheets 4. The pick-up rollers 9a and 9b contact the uppermost one of the sheets 4 and rotate to urge it outward in the feed direction. The pick-up rollers 9a and 9b each has the outer periphery 10a or 10b thereof constituted by a member which exerts a frictional force great enough to pay out the sheet 4. The pick-up rollers 9a and 9b are respectively rotatably supported by one end of roller brackets 11a and 11b via the shafts 12a and 12b thereof. Each of the roller brackets 11a and 11b is connected to the associated pick-up roller 9a or 9b by a one-way clutch, so that the pick-up rollers 9a and 9b may rotate only in the feed direction indicated by an arrow a in FIG. 2. Implemented as bars, the roller brackets 11a and 11b extend in the feed direction and are respectively connected to actuators 17a and 17b at their ends remote from the pick-up rollers 9a and 9b. The actuators 17a and 17b have respectively cylinders 26a and 26b each accommodating, for example, an electromagnetic linear drive motor therein. When the linear drive motors or electromagnetics of the actuators 17a and 17b are driven by a positive current, the roller brackets 11a and 11b are pulled into the associated cylinders 26a and 26b due to the oscillation of the actuators. Conversely, when the drive motos are driven by a negative current, the roller brackets 11a and 11b are forced out of the associated cylinders 26a and 26b due to the oscillation of the actuators. As a result, the pick-up rollers 9a and 9b supported by the roller brackets 11a and 11b, respectively, are selectively moved in the feed direction or the opposite direction or counter-feed direction, depending on the polarity of the motor drive current. The actuators 17a and 17b and actuators 18a and 18b which will be described are opposite in phase to each other, and all of them oscillate at the same frequency and amplitude for the purpose of eliminating vibrations and reducing noise. The frequency and amplitude of oscillation and the phases of the actuators 17a, 17b, 18a and 18b are variable. If desired, the electromagnetic actuators shown and described may be replaced with any other type of actuators such as piezoelectric linear drive actuators or lead screw type actuators.

A pair of feed rollers 13a and 13b are located at the front end of the storing section 1 in parallel with the pick-up rollers 9a and 9b, respectively, and such that their circumferential surfaces are situated at the feed position. The feed rollers 13a and 13b, like the pick-up rollers 9a and 9b, have respectively high friction members 14a and 14b on the peripheries thereof. The feed rollers 13a and 13b are respectively connected to roller brackets 15a and 15b in the same manner as the pick-up rollers 9a and 9b are connected to the roller brackets 11a and 11b. Specifically, each of the feed rollers 13a and 13b is connected to the end of the roller bracket 15a or 15b which is remote from the pick-up roller 9a or 9b via a one-way clutch. The feed rollers 13a and 13b are rotatably only in the feed direction a, FIG. 2. Implemented as bars, the roller brackets 15a and 15b are respectively connected to actuators 18a and 18b at their ends remote from the feed rollers 13a and 13b. The actuators 18a and 18b are identical in construction with the actuators 17a and 17b, i.e., they have cylinders 27a and 27b and move the associated roller brackets 15a and 15b into and out of the cylinders 27a and 27b. Therefore, the feed rollers 13a and 13b supported by the roller brackets 15a and 15b, respectively, are selectively movable in the feed direction or in the counter-feed direction. The actuators 17a and 18a to which the roller brackets 11a and 15a are connected are connected to each other at their ends remote from the rollers 9a and 13a. Likewise, the actuators 17b and 18b are connected to each other at their ends remote from the rollers 9b and 13b. Such a pair of actuator and roller bracket subassemblies are connected together by a joint beam or cross member 19 such that they extend in the feed direction and in parallel with each other in the right-and-left direction, whereby a roller assembly 29 in the form of a letter H is formed. The right and left subassemblies of the H-shaped roller assembly 29 are rotatable about the joint beam 19 in parallel with each other. The joint beam 19 is supported by the support mechanism, not shown, such that the roller assembly 29 is parallel to the top of the sheet stack accommodated in the storing section 1. Lower portions of the pick-up rollers 9a and 9b and feed rollers 13a and 13b contact the top of the sheet stack.

A pair of reverse rollers 20a and 20b are disposed below the guide plate 2 and face the feed rollers 13a and 13b, respectively. Coaxially mounted on a shaft 21, the reverse rollers 20a and 20b partly protrude from the upper surface of the guide plate 2 through openings 38 (only one is shown) which are formed in the guide plate 2. The portions of the reverse rollers 20a and 20b protruding from the guide plate 2 contact respectively the feed rollers 13a and 13b and press the latter by a suitable pressure. A motor or similar drive source, not shown, constantly applies low-torque high-rotation power to the reverse rollers 20a and 20b in a direction for urging the sheets 4 toward the storing section 1, i.e., in a direction b which is the same as the direction a. The friction between the reverse rollers 20a and 20b and the sheet 4 contacting them is selected to be smaller than the friction between the pick-up rollers 9a and 9b and feed rollers 13a and 13b and the sheet contacting them. Of course, the friction acting between each high friction member and the sheet is greater than the friction acting between the sheets 4 which contact each other. Such a configuration is successful in preventing two or more sheets 4 from being fed together.

Line photosensors 22a and 22b are respectively arranged at the right and the left of the path defined by the guide plate 2 in order to continuously sense the sheet 4 over a predetermined range that extends from the storing section 1. The line photosensors 22a and 22b each comprises a plurality of light emitting elements and a plurality of light-sensitive elements which are aligned with each other in the up-and-down direction. The outputs of the light receiving elements are sent to a control circuit 23 shown in FIG. 3. In response to the outputs of the line photosensors 22a and 22b, the control circuit 23 determines whether or not a single sheet 4 has been paid out from the storing section 1 by being separated from the others. Based on the result of decision, the control circuit 23 generates a signal for controlling any of the actuators 17a, 17b, 18a and 18c, as will be described in detail later. Springs or similar biasing means cause the feed rollers 13a and 13b and reverse rollers 20a and 20b and the pick-up rollers 9a and 9b and sheet 4 or, if the sheets 4 are absent, stage 3 to press against each other by a constant pressure. When the sheet 4 is paid out askew or in any other unusual position despite such a uniform pressure distribution to the various rollers, the control circuit 23 immediately controls the actuators 17*a*, 17*b*, 18*a* and 18*b* to pay out the sheet 4 in an adequate condition.

The basic operation of the sheet feeding apparatus having the above construction will be described with reference also made to FIGS. 4A through 4D. It is to be noted that rollers 24 and 25 shown in FIG. 4D cooperate to transport a sheet 4A driven out from the storing section 1 further to a predetermined transport path, not shown.

First, the stage 3 of the storing section 1 is raised by a drive mechanism, not shown, until uppermost sheet 4A of the sheets 4 stacked on the stage 3 abuts against the pick-up rollers 9*a* and 9*b*. At this instant, the reverse levers 5*a* and 5*b* interlocked with the stage 3 are rotated about their fulcrums 6 in the direction opposite to the direction c so as not to obstruct the feed of the sheets 4. Specifically, the reverse levers 5*a* and 5*b* are respectively inclined by a predetermined angle within the slots 2*a* and 2*b* of the guides 2. Subsequently, the reverse rollers 20*a* and 20*b* are rotated in the direction b by a motor or similar drive means. At the same time, the control circuit 23 drives the actuators 17*a*, 17*b*, 18*a* and 18*b* to move the associated roller brackets 11*a* and 11*b* and the associated roller brackets 15*a* and 15*b* toward or away from each other in the feed direction.

Figure 4A:
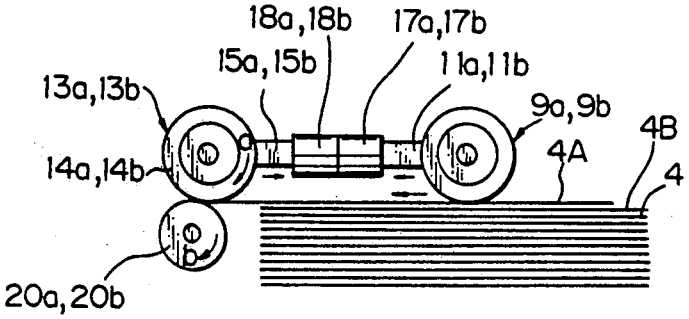
FIGS. 4A through 4D are views demonstrating a sequence of steps which the embodiment of FIG. 1 performs.

Specifically, as shown in FIG. 4A, assume that the roller brackets 11*a* and 11*b* and the roller brackets 15*a* and 15*b* are moved toward each other by the associated actuators, i.e., the whole roller assembly 29 is contracted. Then, the pick-up rollers 9*a* and 9*b* supported by the roller brackets 11*a* and 11*b*, respectively, are moved in the feed direction, while the feed rollers 13*a* and 13*b* supported by the roller brackets 15*a* and 15*b*, respectively, are moved in the counter-feed direction. During such a movement, the pick-up rollers 9*a* and 9*b* are locked by their associated one-way clutches and, therefore, urge the uppermost sheet 4A toward the feed rollers 13*a* and 13*b* due to the friction acting between the high friction members 10*a* and 10*b* and the sheet 4A. On the other hand, the feed rollers 13*a* and 13*b* moving in the counter-feed direction is rotated in the direction a by the one-way clutch thereof while remaining in contact with the reverse rollers 20*a* and 20*b*, respectively. As a result, the leading edge of the sheet A is nipped by the reverse rollers 20*a* and 20*b* and the feed rollers 13*a* and 13*b*. The reverse rollers 20*a* and 20*b* tend to rotate in the direction opposite to the direction b due to the rotation of the feed rollers 13*a* and 13*b*. Nevertheless, the rotating force of the reverse rollers 20*a* and 20*b*, the friction between the rollers 20*a* and 20*b* and the rollers 13*a* and 13*b* and other factors are so selected as to insure the rotation of the rollers 20*a* and 20*b* in the direction b.

Figure 4B:
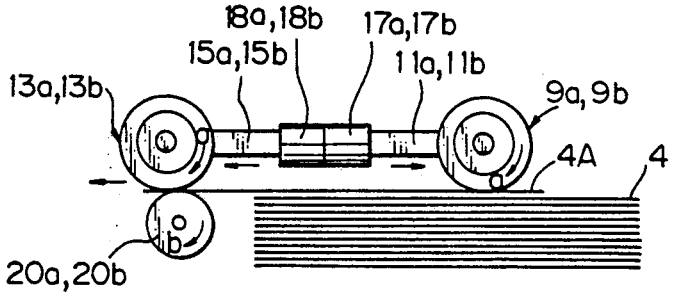

Subsequently, as shown in FIG. 4B, the roller brackets 11*a* and 11*b* and the roller brackets 15*a* and 15*b* are moved away from each other, i.e., the whole roller assembly 29 is expanded. At this time, the feed rollers 13*a* and 13*b* are prevented from rotating by their associated one-way clutches. As a result, the sheet 4A nipped by the feed rollers 13*a* and 13*b* and the reverse rollers 20*a* and 20*b* is fed further forward from the position shown in FIG. 4A by an amount corresponding to the expansion of the roller brackets 15*a* and 15*b*. Despite that the reverse rollers 20*a* and 20*b* tend to return the sheet 4A to the storing section 1 due to the rotation thereof in the direction b, the sheet 4A is not prevented from being fed out of the storing section since the friction acting between the high friction members 14*a* and 14*b* of the feed rollers 13*a* and 13*b* and the sheet 4A is greater than the friction acting between the reverse rollers 20*a* and 20*b* and the sheet 4A. When the sheet 4B just underlying the sheet 4A is paid out together with the sheet 4A, it is urged toward the storing section 1 by the reverse rollers 20*a* and 20*b* since the friction between the sheet 4B and the reverse rollers 20*a* and 20*b* is greater than the friction between the sheets 4A and 4B themselves. At this stage of operation, the pick-up rollers 9*a* and 9*b* move rearward on the uppermost sheet 4A while rotating in the direction a and, therefore, do not effect the feed of the sheet 4A.

Figure 4C:
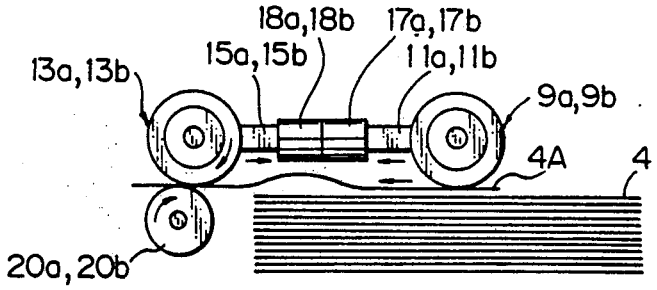

Then, as shown in FIG. 4C, the roller brackets 11*a* and 11*b* and the roller brackets 15*a* and 15*b* are again moved toward each other to contract the roller assembly 29. As a result, the sheet 4A is driven toward the feed rollers 13*a* and 13*b* by the friction between the high friction members 10*a* and 10*b* of the pick-up rollers 9*a* and 9*b* and the sheet 4A by an amount corresponding to the contraction of the roller brackets 11*a* and 11*b*. At this instant, the feed rollers 13*a* and 13*b* rotates little since they are subjected to a rotational load exerted by the reverse rollers 20*a* and 20*b* in the counter-feed direction. Hence, the sheet 4A is driven forward by different amounts of feeding the sheet at opposite ends thereof, i.e., at the feed roller side and the pick-up roller side with the result that part of the sheet 4A lifts away from the underlying sheet. Air enters the resulted gap between the sheet 4A and the underlying sheet, promoting easy separation of the sheet 4A. It is to be noted that the component parts and elements shown and described may be so arranged as to cause part of the sheet 4A to lift by an amount substantially corresponding to the amount of feed by the pick-up rollers 9*a* and 9*b*.

Figure 4D:
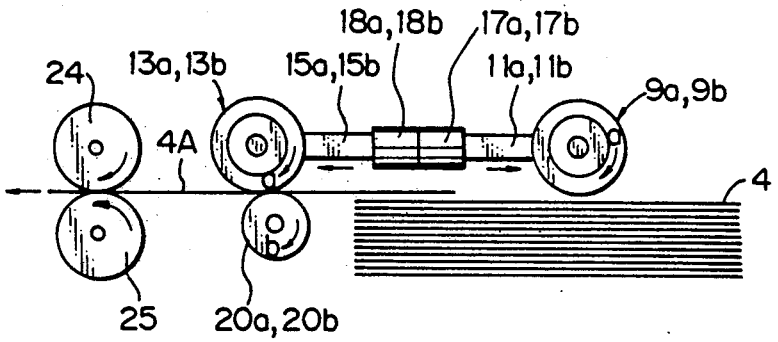
Figure 5A:
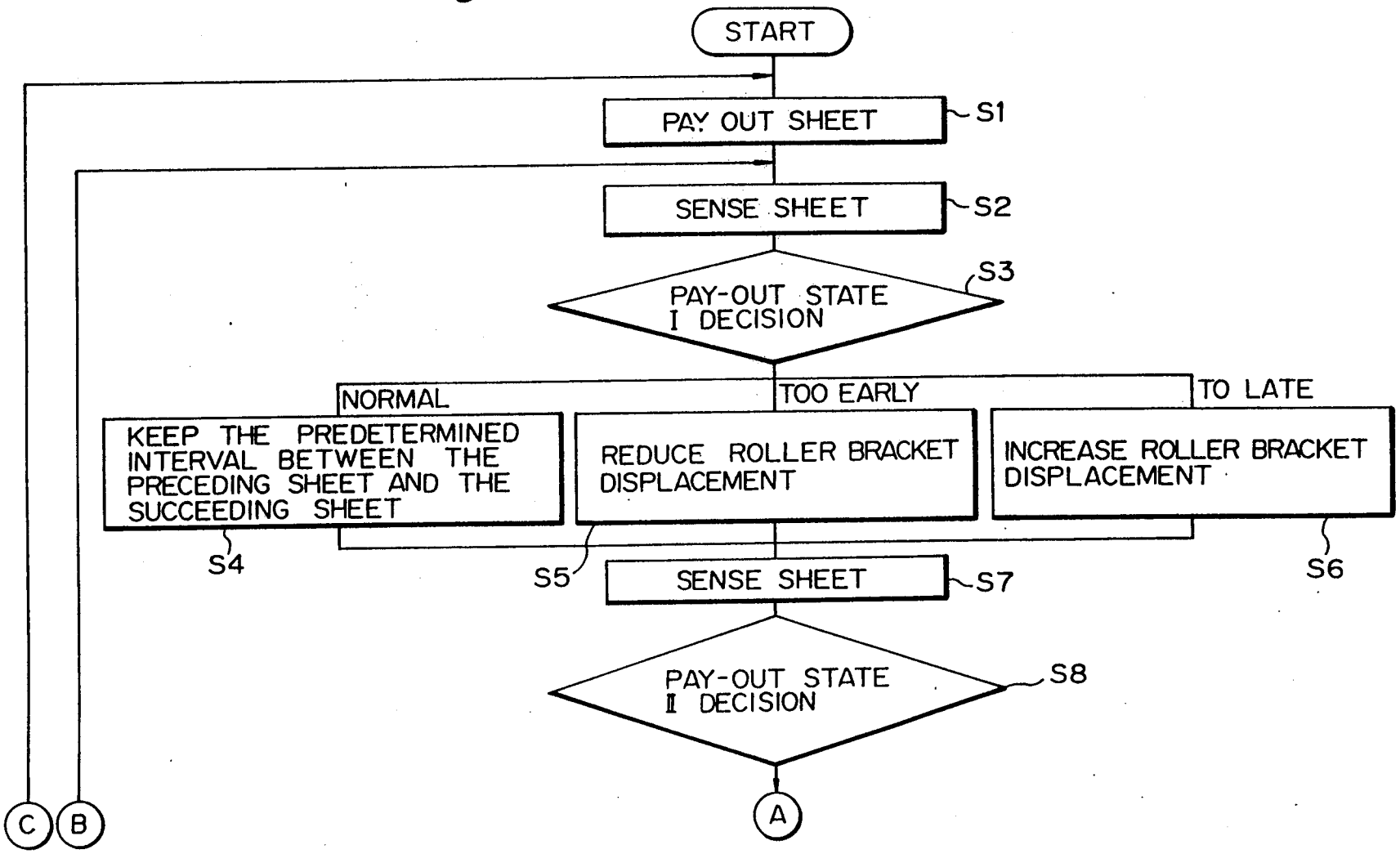
FIGS. 5A and 5B are flowcharts representative of a specific control procedure to be executed by the embodiment of FIG. 1.
Figure 5B:
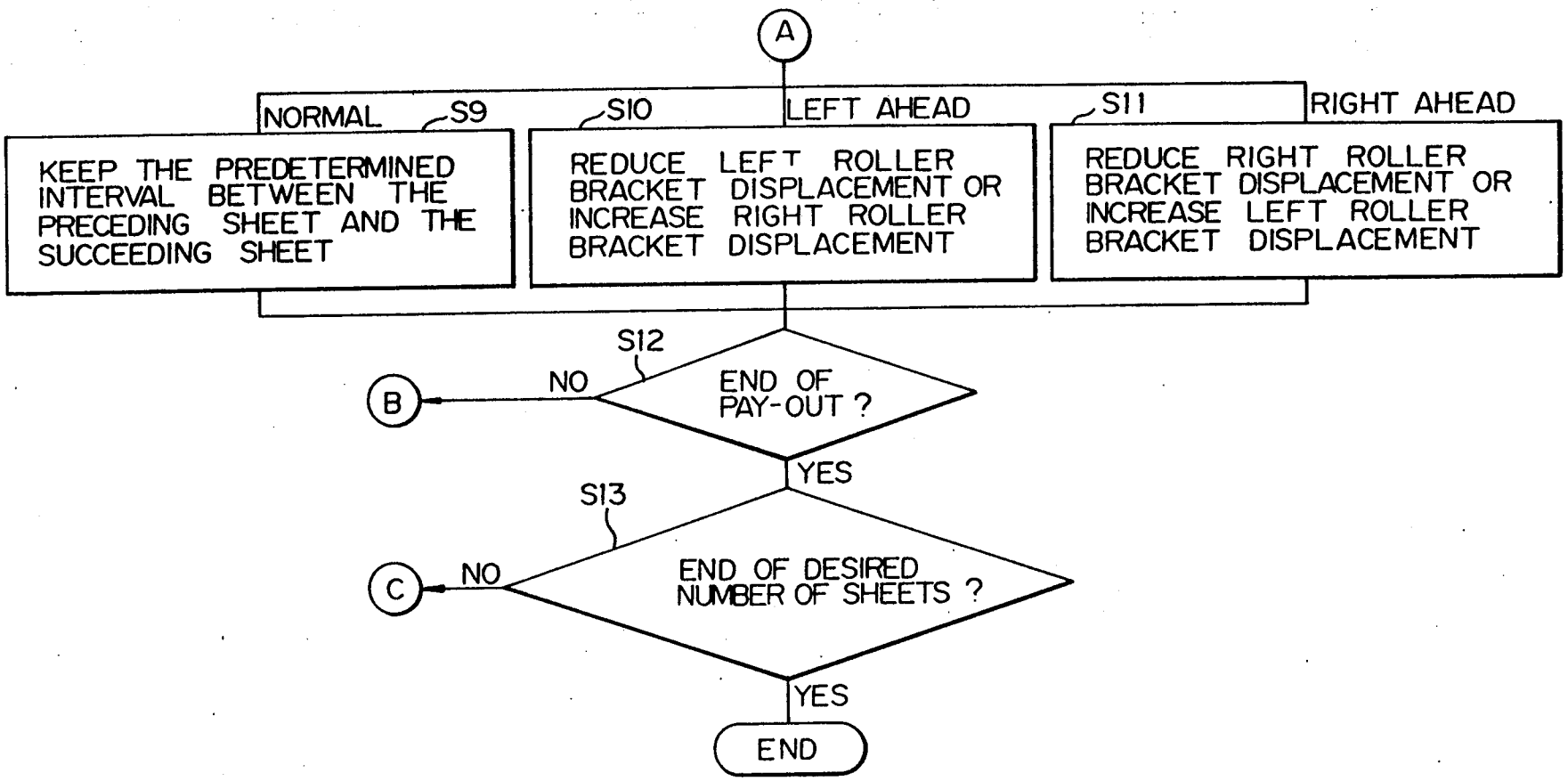

Thereafter, the roller brackets 11*a* and 11*b* and the roller brackets 15*a* and 15*b* are again moved in such a direction that the roller assembly 29 expands, as shown in FIG. 4D. Then, the uppermost sheet 4A is fed forward by the friction between it and the high friction members 14*a* and 14*b* of the feed rollers 13*a* and 13*b* by an amount substantially corresponding to the expansion of the roller brackets 15*a* and 15*b*. As a result, the sheet 4A is straightened again, i.e., the lift reduces to zero. Although the reverse rollers 20*a* and 20*b* exert a force counteracting the feed of the sheet 4A, the former does not interfere with the latter since the friction between the sheet 4A and the feed rollers 13*a* and 13*b* is greater than the friction between the sheet 4A and the reverse rollers 20*a* and 20*b*. Of course, the pick-up rollers 9*a* and 9*b* which are rotated in the direction a do not counteract the feed of the sheet 4A at all.

As soon as the leading edge of the sheet 4A having been paid out as stated above is nipped by the transport rollers 24 and 25 which are in rotation, it is further fed by the rollers 24 and 25 to a predetermined processing section included in the following stage. At this instant, since the pick-up rollers 9*a* and 9*b* and the feed rollers 13*a* and 13*b* rotate in the direction a following the transport speed of the sheet 4A and due to the friction between them and the sheet 4A, they do no tear off or otherwise damage the sheet 4A.

As the above sequence of steps is repeated, a predetermined number of sheets 4 are fed one by one as if they were measuring worms or similar worms. Subsequently, the stage 3 is lowered while causing the reverse levers 5a and 5b to rotate in the direction c. As a result, the reverse rollers 5a and 5b are returned to the phantom line position shown in FIG. 2 while forcing the sheet 4 having been entrained by the overlying sheet 4 toward the reverse rollers 20a and 20b into the storing section 1. It should be noted that the frequency and amplitude of oscillation of the actuators 17a, 17b, 18a and 18b are freely variable to change the feed speed of the sheets 4 from the storing section 1.

Assume that all the sheets 4 except for the lowermost one have been fed out from the stage 3. In this condition, the absorb rollers 8a and 8b do not interfere with the feed of the last sheet 4, toward the feed direction, remaining on the stage 3 since they are rotated in the direction d by the one-way clutches associated therewith. On the other hand, when the pick-up rollers 9a and 9b are moved in the counter-feed direction (see FIG. 4B), they are rotated in the direction a while, at the same time, the absorb rollers 8a and 8b are locked by the associated one-way clutches. As a result, the friction between the high friction members 42a and 42b of the absorb rollers 8a and 8 and the last sheet 4 prevents the sheet 4 from being driven in the reverse direction. Such a procedure is repeated a few times to feed the last sheet 4 toward and between the feed rollers 13a and 13b and the reverse rollers 20a and 20b.

As the trailing edge of the last sheet 4 moves away from the pick-up rollers 9a and 9b and absorb rollers 8a and 8b, the rollers 9a and 9b are brought into contact with the rollers 8a and 8b, respectively. In this condition, the pick-up rollers 9a and 9b continuously move back and forth until the last sheet 4 advances to a predetermined position. It is noteworthy that the noise and wear ascribable to the pick-up rollers 9a and 9b and absorb rollers 8a and 8b are not noticeable despite that they contact each other. Specifically, when the pick-up rollers 9a and 9b move in the feed direction, the absorb rollers 8a and 8b rotate in the direction d despite that the rollers 9a and 9b do not rotate. When the pick-up rollers 9a and 9b move in the counter-feed direction, they rotate in the direction a, but the absorb rollers 8a and 8b do not rotate.

A reference will also be made to FIGS. 3, 5A, 5B and 6 for describing a control method particular to the embodiment. First, a desired number of sheets 4 to be fed out from the storing section 1 and a feed command are sequentially entered on a keyboard or similar input unit, not shown, which is connected to the sheet feeding apparatus. Then, such information is sent to the control circuit 23 via a control section, not shown. In response, the control circuit 23 controls the various members of the apparatus to effect the separation and feed of sheets 4, as described above. As a result, the sheets 4 are sequentially fed out one by one from the storing section (step S1). When the uppermost sheet 4A is paid out from the storing section 1, the line photosensors 22a and 22b respectively located at the left-hand side and the right-hand side with respect to the intended direction of sheet feed continuously sense the sheet 4. The resultant outputs of the line photosensors 22a and 22b are applied to the control circuit 23 as sheet position data (S2). In response, the control circuit 23 determines that a sheet 4 has been paid out to the position where the line photosensors 22a and 22b are located (hereinafter referred to as a pay-out state I) (S3).

By the above-stated decision on the pay-out state I, the control circuit 23 determines whether or not the sheet 4 following the preceding sheet 4 has been paid out earlier or later than a predetermined timing. If the succeeding sheet 4 has been paid out at a predetermined or normal interval after the preceding sheet 4, the control circuit 23 executes a step S7 while maintaining the predetermined interval (S4). At this instant, the control circuit 23 applies a desired voltage to the actuators so that the movement of the roller brackets may not be effected by the loads ascribable to the friction acting between the rollers and the sheet. It should be noted that the oscillation frequency of the actuators are selected to be substantially the same as the natural oscillation frequency of the feed rollers and pick-up rollers in order to prevent the oscillation of the actuators and the voltage applied to the actuators from deviating in phase from each other.

Assume that the succeeding sheet 4 has been paid out earlier than the predetermined timing, i.e., the interval between the time when the leading edge of the preceding sheet 4 with respect to the feed direction has moved away from the line photosensors 22a and 22b and the time when the leading edge of the succeeding sheet 4 is sensed by the line photosensors 22a and 22b is shorter than the predetermined interval. Then, the control circuit 23 reduces the displacement of each of the roller brackets 11a, 11b, 15a and 15b due to the change in the oscillation amplitude of the associated actuator 17a, 17b, 18a or 18b or temporarily stops the movement of the roller brackets, thereby increasing the above-mentioned interval (S5). As a result, the interval between the preceding and succeeding sheets is corrected. Specifically, in the step S5, the control circuit 23 reverses the phase of the voltage being applied to the actuators 17a, 17b, 18a and 18b to thereby sharply attenuate the oscillation amplitude of the actuators. Thereafter, the control circuit 23 adjusts the voltage in such a manner as to maintain the oscillation amplitude of the actuators set up by such sharp attenuation.

Conversely, if the pay-out of the succeeding sheet 4 is effected later than the predetermined timing, the control circuit 23 accelerates the pay-out of the sheet 4. Specifically, the control circuit 23 increases the displacement of the roller brackets 11a, 11b, 15a and 15b due to the change in the oscillation amplitude of the actuators 17a, 17b, 18a and 18b, thereby reducing the interval between the time when the leading edge of the preceding sheet 4 has moved away from the line photosensos 22a and 22b and the time when the leading edge of the succeeding sheet 4 is sensed by the photosensors 22a and 22b (S6). For this purpose, the control circuit 23 adjusts the voltage being applied to the actuators in such a manner as to sharply increase the oscillation amplitude of the actuators, while maintaining the voltage in the same phase.

Since the sharp decrease or sharp increase in the oscillation amplitude of the actuators as stated above invites a noticeable loss of energy, the illustrative embodiment executes a control for minimizing such a loss of energy, although not described specifically.

Figure 6:
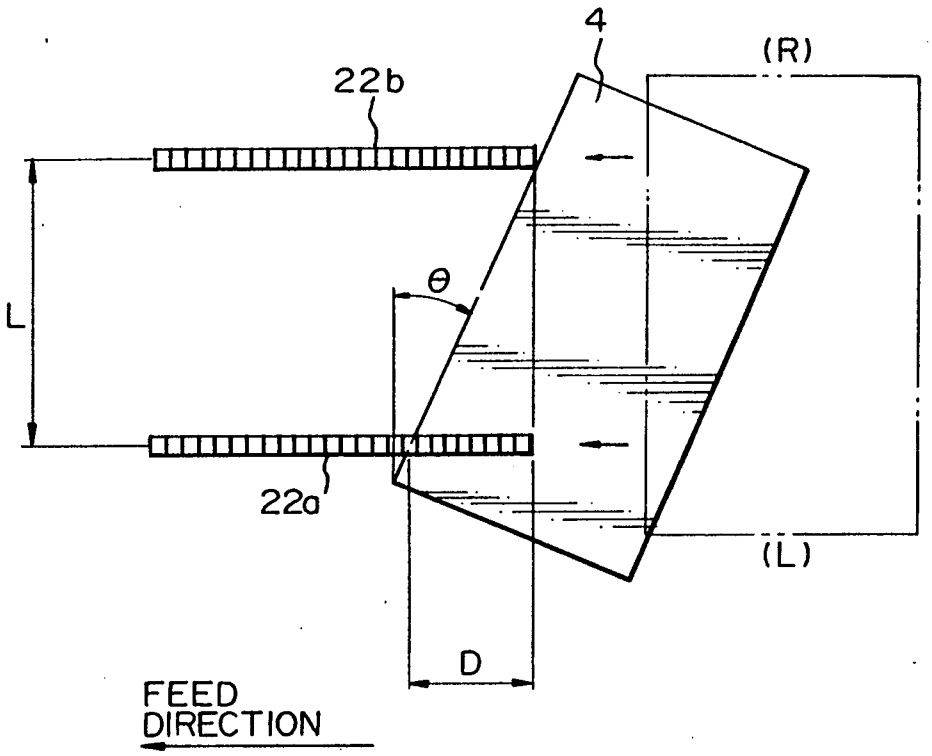
FIG. 6 shows a real-time control particular to the procedure depicted in FIG. 5.

Thereafter, the outputs of the line photosensors 22a and 22b are further fed to the control circuit 23 as sheet position data (S7). Based on this data, the control circuit 23 determines a pay-out state II of the sheet 4, i.e., whether or not the sheet 4 is skewed to the left or to the right (S8). Assume that the sheet 4 has been paid out askew such that the left-hand side thereof precedes the right-hand side in the feed direction, as shown in FIG. 6. Then, the control circuit 23 determines, on the basis of the relation between the distance L between the line photosensors 22a and 22b and the amount of skew D, a skew angle $\theta$ by using an equation $\theta = \tan - 1$ (D/L). The control circuit 23 controls the amplitude of one or both of the left actuators 17a and 18a and the right actuators 17b and 18b in matching relation to the skew angle $\theta$, preceding angle, and pay-out speed. As a result, the displacement of the roller brackets 11a and 11b and/or the displacement of the roller brackets 15a and 15b is increased or decreased.

If the interval between the preceding and succeeding sheets is normal, the control circuit 23 executes a step 12 while maintaining the current voltage being applied to the actuators, i.e., the normal interval (S9).

In the specific condition shown in FIG. 6, the control circuit 23 reduces the displacement of the left roller brackets 11a and 15a or increases the displacement of the right roller brackets 11b and 15b (S10). The control circuit 23 determines whether to increase the displacement of the roller brackets or to reduce it on the basis of the pay-out speed and, in some cases, changes the displacement of both of the right and left roller brackets. Conversely, when the right-hand side of the sheet 4 precedes the left-hand side in the feed direction, the control circuit 23 will reduce the displacement of the right roller brackets 11b and 15b or increases the displacement of the left roller brackets 11a and 15a (S11). Such a correction of the position of the sheet 4 has to be completed before the sheet of interest reaches the transport rollers 24 and 25 which rotate at high speed. The control circuit 23, therefore, completes the control within a predetermined correction time $\Delta t$.

In the illustrative embodiment, the above-mentioned correction time $\Delta t$ is defined as a constant beforehand, and the oscillation frequency fL, total amplitude aL and amplitude aL' at the time of correction of the left actuators 17a and 18 and the oscillation frequency fR, total amplitude aR and amplitude aR' at the time of correction of the right actuators 17a and 18b are used as parameters. Then, the position of the sheet 4 is corrected on the basis of the amount of skew D, as follows:

$$\Delta t = D/|aL' - aR| \cdot f$$

where aL' < aR if the left-hand side is ahead of the right-hand side, or aL' > aR if the latter is ahead of the former $$\Delta t = D/|aR' - aL| \cdot f$$

where aR' > aL if the left-hand side is ahead of the right-hand side, or aR' < aL if the latter is ahead of the former.

The sheet 4 paid out by the above control is transported by the transport rollers 24 and 25 further to a predetermined transport path. On determining that the sheet 4 has been fully paid out from the stage 3 (S12), the control circuit 23 determines whether or not all of the desired number of sheets 4 have been fed out from the stage 3 (S13). If the answer of this decision is negative, the control circuit 23 executes the step S1 and successive steps again. If the answer is positive, the program ends. Such a procedure is repeated until the desired number of sheets 4 have been fed out from the storing section 1.

While the embodiment has been shown and described in relation to an apparatus of the type feeding uppermost one of the sheets 4 stacked in the storing section 1 first, it is also applicable to an apparatus of the type feeding the lowermost sheet first or even to an apparatus which positions a stack of sheets sideways and feeds the rightmost sheet or the leftmost sheet first.

Figure 7:
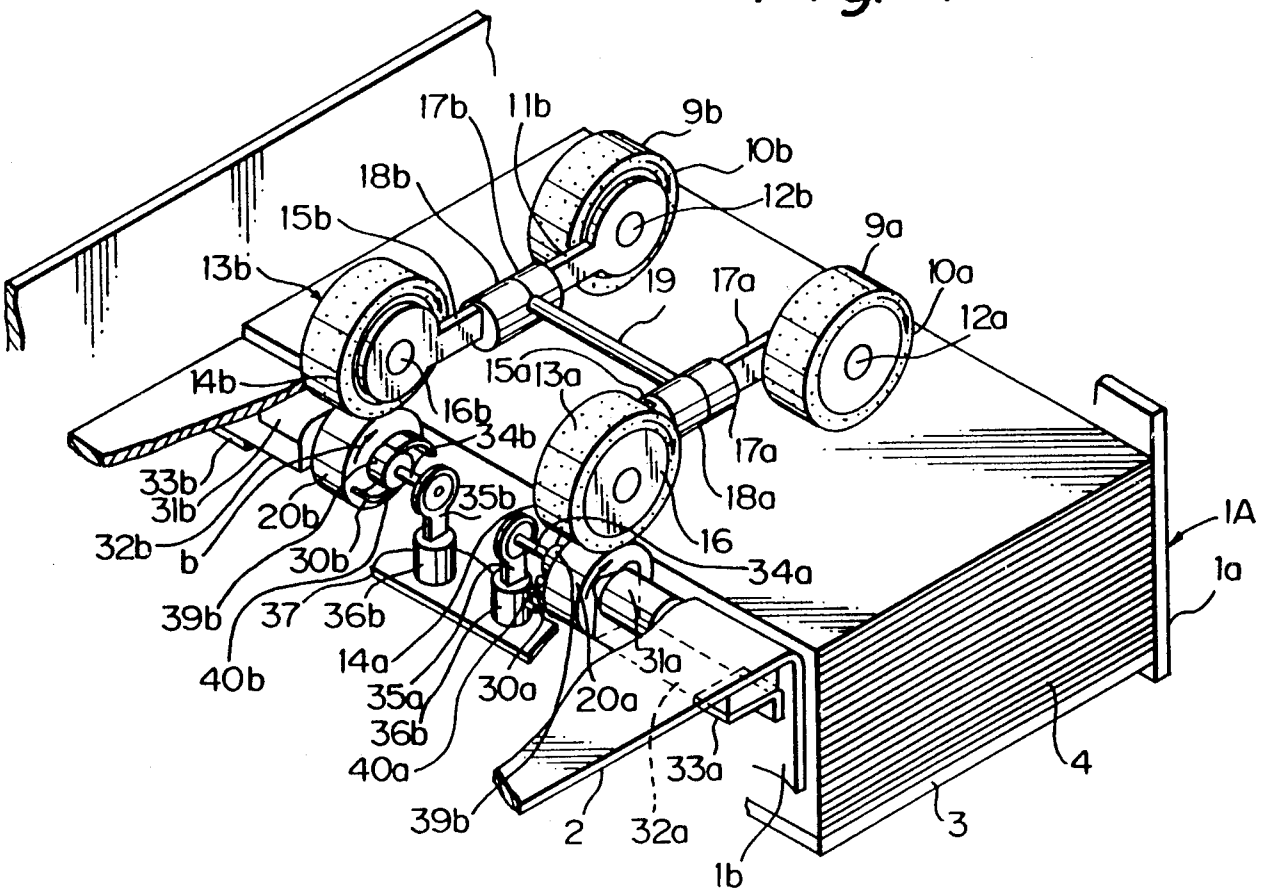
FIG. 7 is a perspective view showing an alternative embodiment of the present invention.
Figure 8:
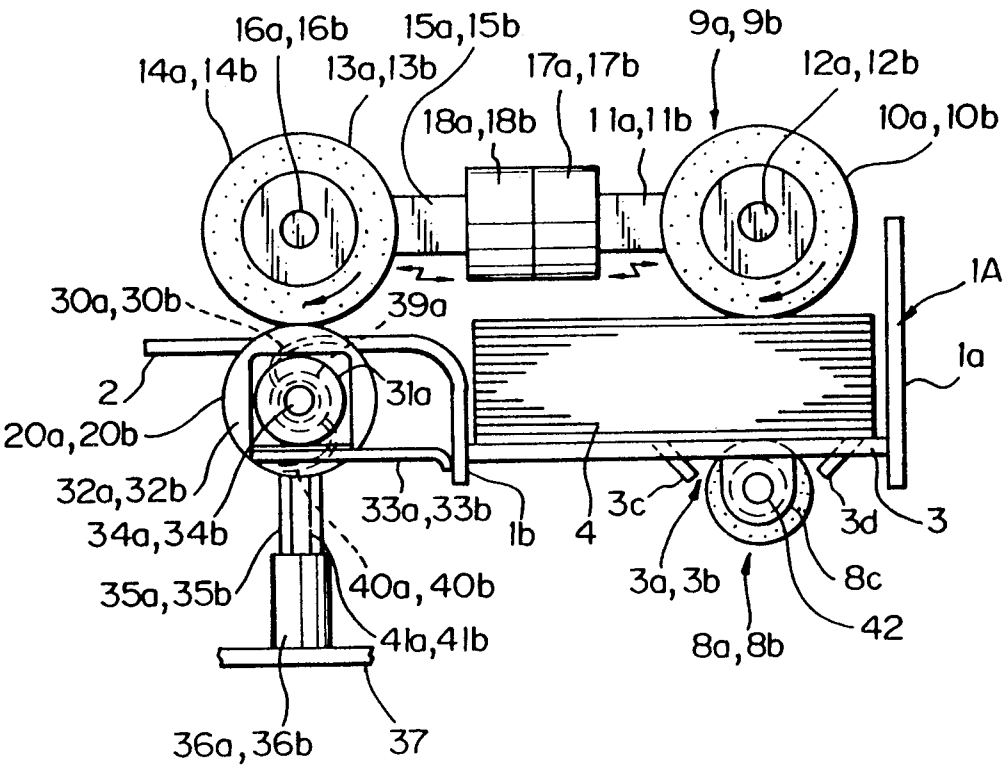
FIG. 8 is a fragmentary side elevation of the alternative embodiment FIG. 1.

Referring to FIGS. 7 and 8, an alternative embodiment of the sheet feeding apparatus in accordance with the present invention will be described. In the figures, the same or similar components and structural elements are designated by like reference numerals, and redundant description will be avoided for simplicity. This embodiment is different from the previous embodiment in the following aspects. First, the reverse rollers 20a and 20b for separating the uppermost sheet from the others are driven independently of each other. Second, the reverse rollers 20a and 20b have respectively reverse arms 30a and 30b integrally therewith for urging the sheet or sheets having been entrained by the uppermost sheet backward into the storing section 1. Third, the reverse levers 5a and 5b of the previous embodiment are omitted from the front frame member 1b, i.e., replaced with such an alternative configuration.

Specifically, reverse motors 31a and 31b are disposed below and adjacent to the laterally opposite ends of the guide plate 2 and drivably connected to the reverse rollers 20a and 20b, respectively. The reverse motors 31a and 31b are respectively mounted on the longer portions of generally L-shaped motor brackets 32a and 32b made of rubber or similar elastic material by suitable fixing means. The longer portions of the motor brackets 32a and 32b each is configured wider and longer than the associated reverse motor 31a or 31b. The longer portions of the motor brackets 32a and 32b are respectively fastened to the horizontal portions of attachments 33a and 33b by screws or similar fastening means. The attachments 33a and 33b are also generally L-shaped and affixed to the front frame member 1b by welding or similar technology. In this configuration, the motor brackets 32a and 32b are held in a horizontal position, and therefore the reverse motors 31a and 31b are also held in a horizontal position through by the associated motor brackets 32a and 32b and attachments 33a and 33b. The reverse motors 31a and 31b are oriented such that the ends of their output shafts 34a and 34b, respectively, face each other.

The shafts 34a and 34b extend out from the associated reverse motors 31a and 31b toward each other along the front end of the storing section 1 and are spaced apart from each other at the ends thereof. Brackets 35a and 35b are disposed between the shafts 34a and 34b and affixed to a structural member 37 which is in turn mounted on the frame member 1b. The ends of the shafts 34a and 34b facing each other each is rotatably supported by the associated bracket 35a or 35b through a bearing. The reverse rollers 20a and 20b are respectively mounted on the shafts 34a and 34b and positioned to face the feed rollers 13a and 13b. The reverse arms 30a and 30b are respectively affixed to or formed integrally with the ends of the reverse rollers 20a and 20b which face each other, so that the arms 30a and 30b may rotate integrally with the associated rollers 20a and 20b. The reverse arms 30a and 30b have respectively hubs 39a and 39b smaller in diameter than the reverse rollers 20a and 20b, and a pair of blades 40a and a pair of blades 40b. The blades 40a and 40b each extends radially outward from the hub 39a or 39b to a position where the end thereof substantially adjoins the circumferential surface of the reverse roller 20a or 20b, while being curved in the intended direction of rotation. The reverse arms 30a and 30b are made of an elastic material such as rubber. While the reverse rollers 20a and 20b are in rotation, the associated reverse arms 30a and 30b each is rotated with the curved blade pair 40a or 40b thereof stretching radially outward due to the centrifugal force.

Rods 41a and 41b extend downward from the brackets 35a and 35b, respectively, and are opratively connected at the lower ends thereof to electromagnets or similar actuators 36a and 36b, respectively. The actuators 36a and 36b move respectively the brackets 35a and 35b up and down, as needed. Specifically, the actuators 36a and 36b usually urge the associated shafts 34a and 34b upward, so that the reverse rollers 20a and 20b remain in contact with the feed rollers 13a and 13b, respectively. In this condition, the apparatus is ready to feed the sheets 4 one by one from a storing section 1A. After a desired number of sheets 4 have been fed out, the actuators 36a and 36b pull down the associated brackets 35a and 35b to thereby lower the shafts 34a and 34b. As a result, the reverse rollers 20a and 20b are brought out of contact with the feed rollers 13a and 13b, so that the sheet or sheets 4 having been entrained by the uppermost sheet 4 out of the storing section 1A may be returned to the storing section 1A.

In operation, the pick-up rollers 9a and 9b and feed rollers 13a and 13b are moved in the feed direction by the actuators 17a–18b, feeding the sheets 4 one by one from the storing section 1A, as in the previous embodiment. When sheets 4 underlying the uppermost sheet 4 are entrained by the latter toward the outside of the storing section 1A, the reverse rollers 20a and 20b are rotated in the counter-feed direction independently of each other by the reverse motors 31a and 31b until only one sheet 4 has been left. Since the reverse rollers 20a and 20b each is driven by an exclusive reverse motor 31a or 31b, the skew control can be effected easily and positively at opposite sides where the reverse rollers 20a and 20b are located, compared to the case wherein they share a single motor.

After a desired number of sheets 4 have been fed out from the storing section 1A, the stage 3 is lowered. As soon as a control section, not shown, detects the downward movement of the stage 3, it causes each of the actuators 36a and 36b to begin pulling down the associated bracket 35a or 35b and, therefore, the free ends of the shafts 33a and 33b of the reverse motors 31a and 31b. Consequently, the motor brackets 32a and 32b carrying the reverse motors 31a and 31b therewith elastically yield downward to release the reverse rollers 20a and 20b from the feed rollers 13a and 13b. The reverse roller 20a and 20b free from the loads having been exerted by the feed rollers 13a and 13b start rotating at high speed in the direction for returning the sheets 4 to the storing section 1A, as indicated by an arrow b in FIG. 7. Then, the reverse arms 30a and 30b rotate at high speed integrally with the reverse rollers 20a and 20b. As a result, the blades 40a and 40b of the reverse arms 30a and 30b stretch radially outward due to the resulted centrifugal force to such an extent that their ends protrude from the peripheral edges of the reverse rollers 20a and 20b. Hence, even when some sheets 4 are left between the feed rollers 13a and 13b and the reverse rollers 20a and 20b, the ends of the blades 40a and 40b protruding from the rollers 20a and 20b sequentially hit against the part of the sheets 4 protruding from the storing section 1. As a result, the sheets 4 of interest are returned to and neatly arranged in the storing section 1.

Thereafter, to feed the sheets 4 remaining in the storing section 1, the brackets 35a and 35b are released from the actuators 36a and 36b, respectively. Then, the motor brackets 32a and 32b are restored due to the elasticity thereof with the result that the brackets 35a and 35b are returned to the substantially horizontal position. Subsequently, the actuators 36a and 36b urge respectively the brackets 35a and 35b upward and thereby cause the reverse rollers 20a and 20b to press themselves against the feed rollers 13a and 13b, respectively. In this condition, the stage 3 is raised again to prepare for the feed of sheets 4.

In this embodiment, the contact of the reverse rollers 20a and 20b with the feed rollers 13a and 13b is implemented by the movement of the former toward the latter caused by the actuators 36a and 36b. Alternatively, the contact may be implemented by the elasticity of the motor brackets 32a and 32b, in which case the actuators 36a and 36b will serve to pull down the reverse rollers 20a and 20b and not to raise them.

Figure 9:
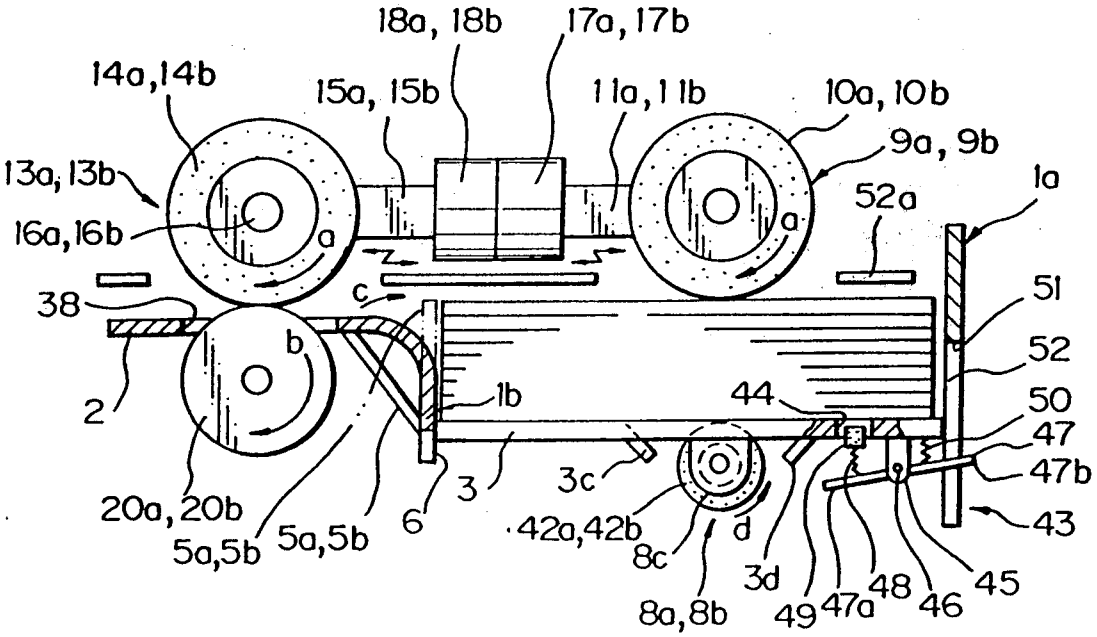
FIG. 9 is a fragmentary side elevation showing another alternative embodiment of the present invention.
Figure 10:
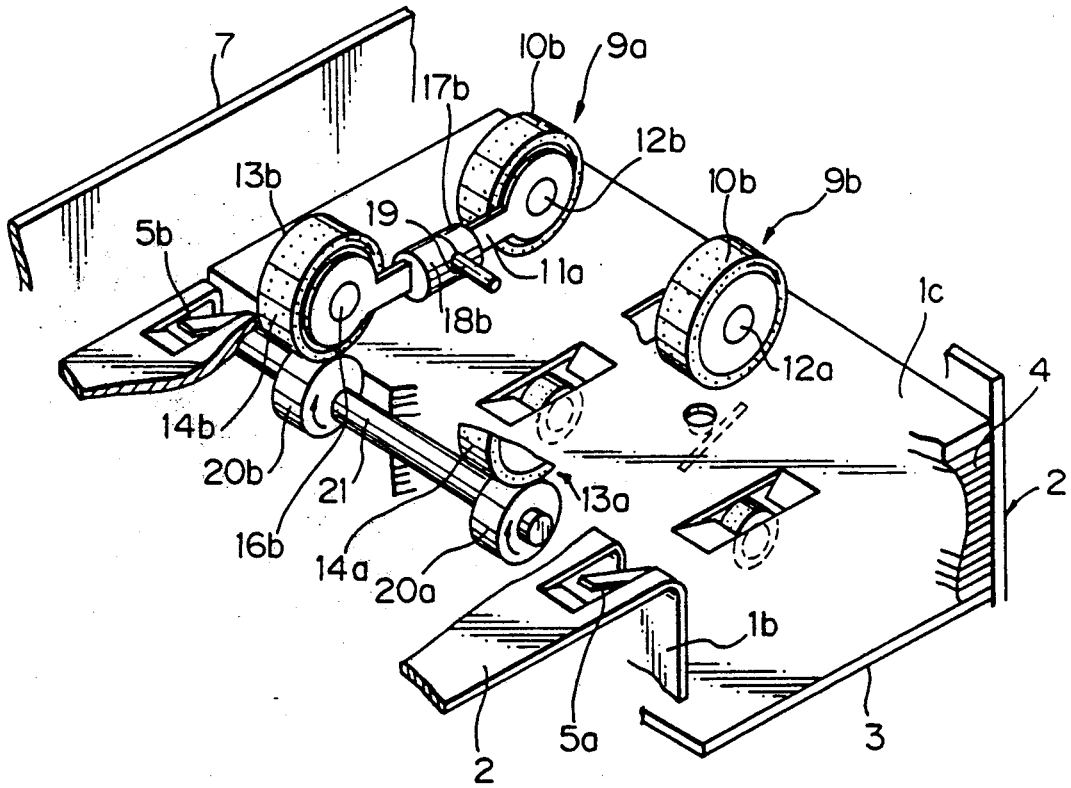
FIG. 10 is a partly taken away perspective view of the embodiment shown in FIG. 9.

Referring to FIGS. 9 and 10, another alternative embodiment of the present invention will be described. This embodiment is essentially similar to the embodiment shown in FIG. 1 except for a sheet raising and holding mechanism 43. Therefore, the same parts and elements as those of the embodiment of FIG. 1 are designated by the same reference numerals and will not be described specifically for simplicity. Briefly, as the number of sheets 4 remaining on the stage 3 decreases, the raising and holding mechanism 43 raises the small number of sheets 4 away from the stage 3 and holds them in a predetermined position.

In detail, the mechanism 43 has a bracket 45 which is affixed to the underside of the stage 3 in close proximity to an opening 44 which is formed through the stage 3. A lever 47 is rotatably mounted on a shaft 46 which is supported by the bracket 45. A compression spring 48 is anchored at one end thereof to one end 47a of the lever 47 and supports a friction member 49 at the other end thereof. The friction member 49 is disposed in the opening 44 of the stage 3. A tension spring 50 is anchored at one end to the other end 47b of the lever 47 and at the other end to the stage 3, constantly biasing the lever 47 toward the stage 3. A guide 52 includes an abutment 51 formed in the rear frame member 1a and causes the lever 47 to rotate against the action of the tension spring 50 as the stage 3 rises. A stop plate 52a is so positioned as to hold the sheets 4 between it and the friction member 49. The force of the tension spring 50 is selected such that the friction member 49 connected to the lever 47 by the compression spring 48 usually does not protrude from the upper surface of the stage 6. The friction between the friction member 49 and the lowermost sheet 4 is selected to be greater than the friction between the sheets 4 and smaller than the friction between the high friction members 10a and 10b of the pick-up rollers 9a and 9b and the high friction members 14a and 14b of the feed rollers 13a and 13b and the uppermost sheet 4.

The raising and holding mechanism 43 having the above configuration will be operated as follows. As the stage 3 sequentially rises due to the feed of the stack of sheets 4 from the storing section 1, the rear end 47b of the lever 47 is brought into contact with the abutment 51 while being guided by the guide 52 which is provided on the rear frame member 1a. As the stage 3 further rises, the lever 47 is rotated clockwise, as viewed in FIG. 9, about the shaft 46 against the action of the tension spring 50 since the rear end 47*b* thereof is stopped by the abutment 51. As a result, the friction member 49 supported by the lever 47 via the compression spring 48 is raised to protrude from the upper surface of the stage 3, urging the stack of sheets 1 upward. Consequently, the sheet stack is pressed against the stop plate 52*a* by the friction member 49. The friction member 49 and stop plate 52*a* so nipping the sheets 4 therebetween prevent all of the sheets 4 remaining on the stage 3 from being driven together toward the feed rollers 13*a* and 13*b* and reverse rollers 20*a* and 20*b*. While the clamping force acting on the sheets 4 which remain on the stage 3 is dependent on the force of the compression spring 48 which supports the friction member 49, the force of the spring 48 is so selected as not to obstruct the feed of the sheets 1.

After a desired number of sheets 4 have been fed out from the storing section 1, the stage 3 is lowered with the result that the reverse levers 5*a* and 5*b* regain the original or upright position. At the same time, the rear end 47*b* of the lever 47 which is mounted on the stage 3 is released from the abutment 51 of the guide 52. Consequently, the lever 47 is rotated counterclockwise, as viewed in FIG. 9, about the shaft 46 by the action of the tension spring 50, retracting the friction member 49 into the opening 44. Hence, even when only one sheet 4 is left in and protruded from the storing section 1, it can be returned into the storing section 1 without being caught by the friction member 49.

Figure 11:
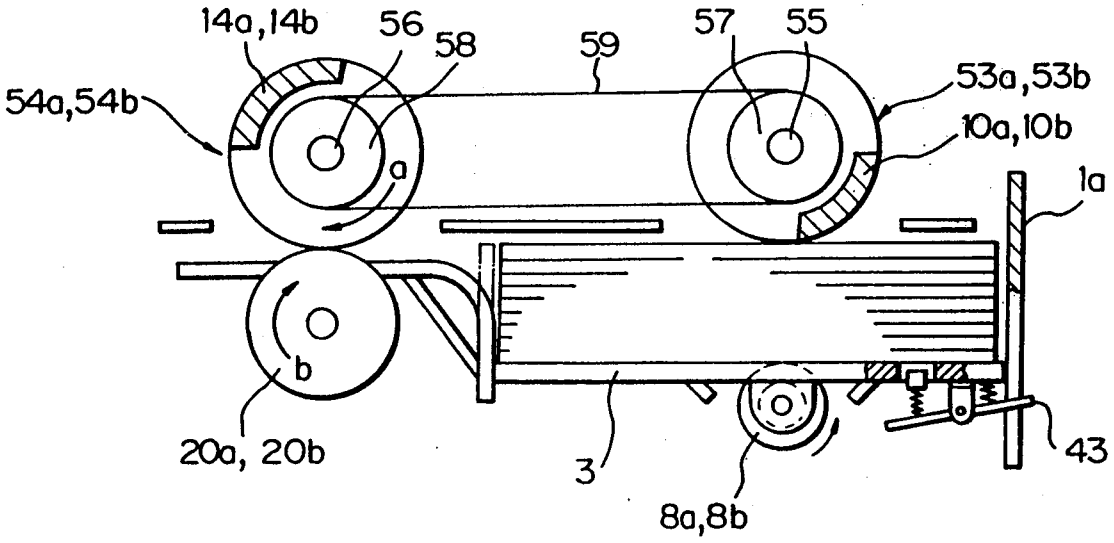
FIG. 11 is a fragmentary side elevation showing another alternative embodiment of the present invention.

FIG. 11 shows another alternative embodiment of the present invention which is similar to the embodiment of FIGS. 9 and 10. In the figures, the same components and structural elements are designated by the same reference numerals, and redundant description will be avoided for simplicity. As shown, pick-up rollers 53*a* and 53*b* are disposed above the stage 3 and have respectively high friction members 10*a* and 10*b* in part of the outer peripheries thereof. Feed rollers 54*a* and 54*b* also have respectively high friction members 14*a* and 14*b* in part of the outer peripheries thereof. The feed rollers 54*a* and 54*b* contact with the reverse rollers 20*a* and 20*b*, respectively, or slightly mesh with the latter by grooves, not shown. Pulley 57 and 58 are respectively mounted on shafts 55 and 56 on which the pick-up rollers 53*a* and 53*b* are mounted. A belt 59 is passed over the pulleys 57 and 58. A motor or similar drive source, not shown, rotates the pick-up rollers 53*a* and 53*b* and feed rollers 54*a* and 54*b* at the same time in a direction indicated by an arrow a in the figure, while rotating the reverse rollers 20*a* and 20*b* in a direction indicated by an arrow b. The sheet raising and holding mechanism 43 is associated with the stage 3, as in the embodiment of FIGS. 9 and 10. The operation of this embodiment and the advantages attainable therewith will be readily understood by analogy. The difference is that the pick-up rollers 53*a* and 53*b* simply rotate in the direction a shown in FIG. 11 and do not move back and forth in a reciprocating motion. Therefore, it is not necessary to provide each of the absorb rollers 8*a* and 8*b* with a one-way clutch.

While the embodiment of FIGS. 9 and 10 and the embodiment of FIG. 11 both use the compression spring 48 to support the friction member 49 and use the tension spring 50 to bias the lever 47, the springs 48 and 50 may be replaced with leaf springs or torsion springs, if desired.

In summary, it will be seen that the present invention provides a method of feeding sheets and an apparatus therefor which achieve various unprecedented advantages, as enumerated below.

(1) Pick-up rollers and feed rollers are moved in an intended direction sheet feed in contact with a sheet to pay it out in such a manner as to repetitively draw it. This allows a sheet being paid out to be surely separated from the others even when it adheres relatively firmly to the underlying sheet.

(2) Linear drive actuators are associated with pick-up rollers and feed rollers. Generally, linear drive actuators are small size and, therefore, promotes the miniaturization of the apparatus. The miniaturization is further promoted since the apparatus does not include a belt, pulleys, etc.

(3) Since feed rollers and reverse rollers have only to remain in pressing contact with each other during feeding operation, a sheet can be surely separated and fed out at all times without resorting complicated maintenance.

(4) The movement of the pick-up rollers and feed rollers toward and away from each other, i.e., actuators for driving the two kinds of rollers are controlled independently of each other with regard to repetition frequency, oscillation amplitude and phase. This facilitates the control over the pay-out of a sheet and reduces vibrations and noise.

(5) Right and left reverse rollers are driven independently of each other and, after the a sheet has been paid out, moved away from feed rollers so as to render the sheet having been paid out freely movable. Reverse arms are associated with the reverse rollers which rotate at high speed when moved away from the feed rollers. The reverse arms return the sheet remaining between the reverse rollers and the feed rollers into a storing section to thereby prevent two or more sheets from being fed together. Moreover, a sheet or sheets having been entrained by the the uppermost sheet are surely returned even when such sheets are fed askew. In addition, the structure is simple, economical, and reliable.

(6) Roller moving means move pick-up rollers and feed rollers toward and away from each other to pay out a sheet from a storing section. Sensing means continuously senses the opposite side edges of the sheet being paid out over a predetermined range. Whether or not the sheet being paid out is accompanied by other sheets, delayed or fed askew is determined on the basis of the output of the sensing means. When the sheet of interest is accompanied by other sheets, the amplitudes of the right and left roller moving means are reduced to an adequate degree or to zero. When the pay-out of the sheet is delayed, the amplitudes of the roller moving means are increased. If the sheet is paid out askew, the amplitude of oscillating means associated with at least one of the right and left roller moving means is increased or decreased. Hence, the separation and pay-out condition can be controlled sheet by sheet, so that the irregularity heretofore encountered is eliminated. In addition, since the displacement of the roller brackets is forcibly controlled by the voltage to be applied to the actuators and the phase thereof, the roller brackets can be braked or accelerated without relying only on the unstable loads derived from the friction between the rollers and the sheet. This further promotes rapid response and following ability.

(7) The separation and pay-out condition is determined and controlled sheet by sheet and, therefore, can be controlled on a real-time basis with ease.

(8) A stage to be loaded with a stack of sheets is formed with openings which face pick-up rollers. Absorb rollers are mounted on the underside of the stage in such a manner as to be rotatable in an intended direction of sheet feed, and each is received in respective one of the openings and does not protrude from the upper surface of the stage. An additional opening is formed through the stage independently of the openings in which the absorb rollers are received. A lever is rotatably mounted on the underside of the stage. A friction member is supported by one end of the lever via spring means and received in the above-mentioned additional opening. The friction member exerts friction smaller than the friction between the pick-up rollers and a sheet and greater than the friction between sheets. Biasing means yieldably biases the lever to prevent the friction member from protruding from the upper surface of the stage. An abutment is provided in a storing section and, as the stage rises due to the feed of sheets out of the feeding section, stops the other end of the lever to thereby cause the lever to rotate. A stop plate receives sheets raised by the friction member which protrudes from the upper surface of the stage when the lever is so rotated. After the trailing edge of the last sheet has been moved away from the pick-up rollers and absorb rollers, the pick-up rollers roll or slide on the absorb rollers until the last sheet reaches a predetermined position. The pick-up rollers, therefore, do not roll or slide in direct contact with the stage which is fixed in plate, i.e., the absorb rollers absorb noise otherwise produced by the pick-up rollers. In addition, the friction members provided on the circumferential surfaces of the pick-up rollres undergo a minimum of wear. Moreover, when the number of sheets remaining on the stage decreases to a predetermined one, the friction member protrudes from the stage to urge the sheets against the stop plate. This is successful in preventing the sheets remaining on the stage from being paid out together toward coactive feed rollers and reverse rollers.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A method of controlling an apparatus for sequentially feeding an accumulation of sheets stored in a storing section one by one comprising the steps of:

pressing a bottom of the accumulation of sheets upward;

frictionally engaging an uppermost sheet of the accumulation of sheets by a pair of pick-up rollers moveable in a feeding direction;

in response to voltage signals applied to actuators, causing the pair of pick-up rollers and a pair of feed rollers to repetitively move toward and away from each other in the feeding direction to feed the uppermost sheet engaged by the pick-up rollers from the storing section in the feeding direction and into frictional engagement with the feed rollers to pay out the uppermost sheet;

urging any further sheet underlying the uppermost sheet, and erroneously moved out of the storing section by the pair of pick-up rollers, in a counter-feeding direction to separate the further sheet from the uppermost sheet and return the further sheet to the storage area;

continuously sensing the opposed side edges of sheets paid out by the feed rollers over a predetermined range to provide sense signals;

from the sense signals, determining whether the sheet following the uppermost sheet is paid out by the feed rollers at a timing earlier than a predetermined timing and, if the following sheet is paid out at the earlier timing, reducing an amplitude of movement of the pick-up rollers and the feed rollers by inverting a phase of the voltage applied to the actuators to thereby sharply attenuate an oscillation amplitude of the actuators and by adjusting the voltage to maintain the oscillation amplitude of the actuators to be set up by the sharp attenuation;

from the sense signals, determining whether the sheet following the uppermost sheet is paid out by the feed rollers later than the predetermined timing and, if the following sheet is paid out at a timing later than the predetermined timing, increasing the amplitude of movement of the pick-up rollers and feed rollers by maintaining the voltage being applied to the actuators of the rollers in the same phase and adjusting the voltage being applied to sharply increase the oscillation amplitude of the actuators; and from the sense signals, determining whether the sheet being paid out is skewed and, if the sheet being paid out is askew, causing the actuators to regulate the amplitude of movement of either one of the pairs of pick-up rollers and feed rollers in such a manner as to selectively change the phase of the voltage to be applied to the actuators to substantially 0 degree or to 180 degrees, and applying the voltage when needed.

2. An apparatus for sequentially feeding sheets one by one, comprising a storing section for storing said sheets, and pay-out means for paying out one of said sheets in a predetermined feed direction, and causing part of the sheet being paid out to bend; and wherein said storing section comprises pressing means for pressing said sheets stored in said storing section against said pay-out means, and said pay-out means comprises:

first support means and second support means sequentially arranged in said feed direction to face said storing section, and each being expansible and contractible in the opposite direction to the other;

pay-out rollers each being mounted on one end of a respective one of said first and second support means and rotatable only in the same direction as the other; and a separation roller located in close proximity to said pay-out roller mounted on said second support means and rotatable in the same direction as said pay-out roller.

3. An apparatus in accordance with claim 2, wherein said first and second support means are connected to each other to form a support subassembly with, a plurality of said support subassemblies being connected to each other by a connecting member in a direction substantially perpendicular to said feed direction.

4. An apparatus for sequentially feeding an accumulation of sheets stored in a storing section one by one in a predetermined feed direction which is substantially perpendicular to a direction of said accumulation, one of said sheets positioned at one side of said accumulation being first, said apparatus comprising:

pressing means for pressing said accumulation of sheets to one side in said direction of accumulation within said storing section;

first pay-out means abutting against the surface of said accumulation of sheets located at said one side to which said pressing means presses said accumulation, and repetitively movable along said surface in said feed direction to pull out the sheet from said accumulation;

second pay-out means located downstream of said first pay-out means with respect to said feed direction for abutting against the sheet having been paid out by said first pay-out means, and movable in said feed direction in response to the movement of said first pay-out means to pay out said sheet further to a predetermined transport path; and separating means located to face said second pay-out means for abutting against another sheet being entrained by said sheet having been paid out while adhering to the rear of said sheet, and movable in a counter-feed direction opposite to said feed direction to separate said another sheet from said sheet having been paid out.

5. An apparatus in accordance with claim 4, said first pay-out means comprises:

a pair of pick-up rollers located at said one side of said accumulation and spaced apart from each other by a predetermined distance in a direction substantially perpendicular to said feed direction; and roller moving means for causing said pair of pick-up rollers to repetitively move in said feed direction;

said pick-up rollers, when moved in said feed direction by said roller moving means, being prevented from rotating to thereby pull out the sheet from said accumulation and, when returned in said counter-feed direction, rotating on said sheet in said feed direction.

6. An apparatus in accordance with claim 5, wherein said roller moving means comprises:

support means supporting said pick-up rollers while allowing shafts on which said pick-up rollers are mounted to rotate only in one direction; and linear drive actuators for causing said support means to move linearly in a reciprocating motion in said feed direction to thereby move said pick-up rollers repetitively in said feed direction;

said actuators varying the amplitude and repetition frequency of said reciprocating motion of said support means, as needed.

7. An apparatus in accordance with claim 4, wherein said second pay-out means comprises:

a pair of feed rollers located at one surface of the sheet having been paid out by said first pay-out means and spaced apart from each other by a predetermined distance in a direction substantially perpendicular to said feed direction; and roller moving means for moving said pair of feed rollers repetitively in said feed direction;

said pair of feed rollers, when moved in said counter-feed direction, rotating in said counter-feed direction and, when returned in said feed direction, being preventing from rotating.

8. An apparatus in accordance with claim 7, wherein said roller moving means comprises:

support means supporting said feed rollers while allowing shafts on which said feed rollers are mounted to rotated only in one direction; and linear drive actuators for causing said feed rollers to move linearly in a reciprocating motion in said feed direction to thereby move said feed rollers;

said actuators varying the amplitude and repetition frequency of said reciprocating motion of said support means, as needed.

9. An apparatus in accordance with claim 4, wherein said first pay-out means comprises:

a pair of pick-up rollers located at said one side of said accumulation and spaced apart from each other by a predetermined distance in a direction substantially perpendicular to said feed direction; and roller moving means for causing said pick-up rollers to repetitively move in said feed direction;

said second pay-out means comprising:

a pair of feed rollers located downstream of said pick-up rollers with respect to said feed direction and parallel to said pick-up rollers; and roller moving means for moving said feed rollers repetitively in said feed direction;

said roller moving means of said first pay-out means and said roller moving means of said second pay-out means being interlocked with each other such that said pick-up rollers and said feed rollers repetitively move toward and away from each other.

10. An apparatus in accordance with claim 9, wherein said roller moving means of said first pay-out means and said roller moving means of said second pay-out means comprise:

support means supporting respectively said pick-up rollers and said feed rollers in alignment with each other in said feed direction such that said pick-up rollers and said feed rollers are positioned parallel to each other; and actuators for causing said support means respectively associated with said pick-up rollers and said feed rollers to contract and expand in opposite directions to each other to thereby move said pick-up rollers and said feed rollers toward and away from each other.

11. An apparatus in accordance with claim 4, wherein said pressing means comprises an absorb roller located to face said first pay-out means and rotatable in said feed direction in contact with the other surface of said accumulation of sheets.

12. An apparatus in accordance with claim 4, wherein said separating means comprises:

a pair of reverse rollers located to face said second pay-out means with the intermediary of a predetermined feed plane and rotatable in said counter-feed direction; and a pair of reverse arms each being associated with one of said pair of reverse rollers and rotatable integrally with said associated reverse roller to neatly arrange the sheet having been returned to a predetermined accumulating position by said reverse rollers;

said reverse rollers each being driven independently of each other.

13. An apparatus in accordance with claim 12, wherein said separating means further comprises means for pressing said reverse rollers against said second pay-out means in the event of pay-out of the sheet and, after the pay-out, moving said reverse rollers slightly away from said second pay-out means.

14. An apparatus in accordance with claim 10, further comprising a pair of reverse rollers located to face said pair of feed rollers and rotatable in said counter-feed direction for separating another sheet being entrained by said one sheet in close contact with said one sheet and return said another sheet to said storing section;

control means for controlling the amplitude of movement of said pick-up rollers and said feed rollers by selectively changing the phase of a voltage to be applied to said actuators to 0 degree or 180 degrees and applying said voltage when needed; and means for sensing opposite side edges of the sheet being paid out by said pick-up rollers and said feed rollers continuously over a predetermined range;

said control means determining whether or not said sheet being sensed is entraining another sheet, is delayed, or is paid out askew, and reducing, if said sheet is entraining another sheet, the amplitude of movement of said rollers or once stopping the movement of said rollers, increasing, if said sheet is delayed, the amplitude of movement of said rollers, or increasing or decreasing, if said sheet is paid out askew, the amplitude of movement of either one of each of said pairs of rollers.

15. An apparatus in accordance with claim 4, further comprising a sheet raising and holding mechanism which comprises:

a bracket mounted on the rear of said pressing means in close proximity to an opening formed through said pressing means;

a lever mounted on said bracket and rotatable about a shaft;

a friction member mounted on one end of said layer by a compression spring and movably received in said opening;

a tension spring constantly biasing the other end of said lever toward said pressing means;

a guide provided on a rear frame member and including an abutment for causing said lever to rotate against the action of said tension spring as said pressing means is raised; and a stop plate for holding said accumulation of sheets in cooperation with said friction member.

16. An apparatus in accordance with claim 4, further comprising a sheet raising and holding mechanism for raising a small number of sheets which comprises:

a bracket mounted on the underside of said pressing means in the proximity of the rear end thereof;

a lever horizontally and rotatably mounted on a shaft fixed on said bracket;

a friction member mounted on an end of a torsion spring anchored at one end of said lever and movably inserted in an opening formed on said pressing means;

a tension spring having one end anchored at another end of said lever and having its other end anchored at said pressing means for constantly biasing the other end of said lever toward said pressing means;

a guide vertically formed on a rear frame member and having an upper end which abuts said other end of said lever and works to cause said lever to rotate about said shaft against the action of said tension spring when said pressing means is raised; and a stop plate horizontally positioned over said opening at a predetermined height for holding the accumulation of sheets in cooperation with said friction member when said other end of said lever is rotated by said upper end of said guide.

17. An apparatus for sequentially feeding an accumulation of sheets stored therein one by one in a predetermined feeding direction which is substantially perpendicular to a direction of said accumulation, said apparatus comprising:

a storing section delimited by a rear frame member, a front frame member, and a pair of side frame members connecting said front and rear frame members for storing the accumulation of sheets;

a moveable stage member for supporting the accumulation of sheets within said storage section and for pressing the accumulation of sheets in the direction of accumulation;

a roller assembly disposed adjacent said storing section on the side of the accumulation of sheets opposite said stage, said roller assembly having a pair of support subassemblies which are disposed in parallel at a predetermined distance and which both are connected rotatably by a cross member extending in the feeding direction;

each of said subassemblies having a pair of cylindrical actuators connected end to end in the proximity of said cross member, with each actuator having an elastic ram therein, a pick-up roller with a frictional peripheral member rotatably mounted on an end of one of said elastic rams by a horizontal shaft mounted thereon, and a feeding roller with a frictional peripheral member rotatably mounted on an end of the other of said elastic rams by a horizontal shaft mounted thereon, with the pair of said pick-up rollers of said subassemblies being horizontally positioned over the rear end of the accumulation of sheets at a predetermined distance and rotated in the feeding direction for picking up an uppermost sheet from the accumulation of sheets, and with the pair of said feeding rollers of said pair of subassemblies being positioned in the proximity of the front end of the accumulation of sheets at a height equal to that of said pick-up rollers and rotated in the feeding direction for feeding the uppermost sheet;

a pair of reverse rollers mounted on a horizontal shaft and respectively directly below respective said feeding rollers with a predetermined gap therebetween and being rotated in the feeding direction for separating an underlying sheet from the uppermost sheet;

a pair of frictional absorb rollers each located directly below a respective said pick-up roller in an opening formed on said stage such that upper surfaces of said absorb rollers are at the height of the support surface of said stage;

a pair of reverse levers each mounted for rotation about a fulcrum on said front frame member and disposed in a slot formed in a guide plate extending from said front frame member in the feeding direction, said pair of reverse levers being rotated clockwise to return the underlying sheet to said storing section;

a pair of line photosensors located along said guide plate in the feeding direction for a predetermined distance for sensing the opposite edges of a sheet paid out by said feeding rollers; and a control circuit, electrically connected to said pair of line photosensors and said actuators, for controlling said actuators to correct an interval between the preceding and succeeding paid out sheets and any skew of the paid-out sheet in response to signals from said pair of line photosensors.

* * * * *